US006592534B1

(12) United States Patent
Rutt et al.

(10) Patent No.: US 6,592,534 B1
(45) Date of Patent: Jul. 15, 2003

(54) INFLATABLE MEDICAL APPLIANCE FOR PREVENTION OF DVT

(75) Inventors: Christian R. Rutt, Chester, NJ (US); Henry John McVicker, Madison, NJ (US)

(73) Assignee: Aircast, Inc., Summit, NJ (US)

( * ) Notice: Subject to any disclaimer, the term of this patent is extended or adjusted under 35 U.S.C. 154(b) by 0 days.

(21) Appl. No.: 09/472,292

(22) Filed: Dec. 27, 1999

(51) Int. Cl.[7] ..... A61H 19/00; A61H 7/00
(52) U.S. Cl. ..... 601/151; 601/152
(58) Field of Search ..... 601/149–152; 602/13, 27, 65, 23, 60–62; 128/882, DIG. 20; 606/202

(56) References Cited

U.S. PATENT DOCUMENTS 2,781,041 A * 2/1957 Weinberg ..... 128/60
3,407,406 A * 10/1968 Werner et al.
3,901,221 A * 8/1975 Nicholson ..... 128/24 R
4,206,751 A * 6/1980 Schneider ..... 128/24 R
4,338,923 A * 7/1982 Gelfer ..... 128/24 R
4,947,834 A * 8/1990 Kartheus et al. ..... 128/64
5,218,954 A * 6/1993 Van Bemmelen ..... 128/24 R
5,354,260 A * 10/1994 Cook ..... 602/13
5,437,610 A * 8/1995 Cariapa et al. ..... 601/152
5,443,440 A * 8/1995 Tumey et al. ..... 601/152
5,843,007 A * 12/1998 McEwen ..... 601/152
5,891,065 A * 4/1999 Cariapa et al. ..... 601/152
6,319,215 B1 * 11/2001 Manor ..... 601/152

* cited by examiner

*Primary Examiner*—Denise M. Pothier
(74) *Attorney, Agent, or Firm*—Jones Day

(57) ABSTRACT

An inflatable foot cuff for treatment of deep vein thrombosis includes a generally flexible body member configured to envelop a foot of a human and having a central region adjacent to the sole of the foot when applied thereon. A first inflatable air cell is disposed in the central region and extends generally from at least the ball of the foot to at least the heel of the foot. A second smaller separately inflatable air cell is disposed within a distal portion of the first air cell. Intermittent sequential inflation of the second distal air cell followed by inflation of the first air cell causes blood flow from the distal region of the foot to the proximal region of the foot and then up into the user's leg. The body member is also provided with preinflated air cells at counterforce pressure points to alleviate chafing and irritation of the skin when the foot cuff is operated.

25 Claims, 3 Drawing Sheets

INFLATABLE MEDICAL APPLIANCE FOR PREVENTION OF DVT

BACKGROUND OF THE INVENTION

1. Field of the Invention

The present invention relates generally to the construction of a medical appliance to be applied to a foot of a human patient for reduction of the risk of deep vein thrombosis (DVT). More specifically, it relates to a dual stage inflatable cuff that can be cycled intermittently to enhance blood circulation in a leg of a human patient.

2. Description of the Related Art

Therapeutic intermittent pneumatic compression of the leg for prevention of DVT after surgery has been used for many years, and a variety of devices have been developed for its application. Intermittent pneumatic compression is the technique of cyclically compressing the limb with air pressure so as to enhance circulation of blood. It has been shown effective in reducing the risk of thrombosis after surgery and for treatment of vascular deficiencies. Roberts et al., "Hemodynamics of Lower Limb in Man," *Brit. J. Surg.*, Vol. 59, No. 3, pp. 223–226, March 1972, reports, for example, that intermittent pressure applied with an inflatable plastic splint causes an increase in venous peak flow directly proportional to the rate of pressure application, the venous peak flow being maximal at a pressure inflation rate of about 10 mmHg per second, with the maximum venous peak flow being reached when the intermittent pressure is applied at one minute intervals.

A system for applying therapeutic intermittent pressure to a limb is disclosed, for example, in U.S. Pat. No. 5,588,955 issued to Johnson, Jr. et al. and commonly assigned herewith, the disclosure of which is incorporated herein by reference in its entirety. The '955 system generally comprises a pump, a reservoir which receives pressurized air from the pump, an inflatable cuff for sequentially applying pressure to the limb, means for intermittently and quickly transmitting pressurized air from the reservoir to the inflatable cuff, and pressure relief means operatively coupled to the inflatable cuff for limiting the pressure therein. In the operation of a preferred embodiment, the pump operates substantially continuously to supply a steady flow of pressurized air to the reservoir. The means for intermittently transmitting pressurized air from the reservoir to the inflatable cuff comprises a valve operatively disposed between the reservoir and cuff and a timer operatively coupled to the valve. The valve is normally in a closed position, so that pressurized air is allowed to build up in the reservoir to a level several times above that normally desired for therapeutic compression. The timer is set up to open the valve to release pressurized air from the reservoir to the inflatable cuff at predetermined intervals and for a predetermined duration. This results in a very rapid pressurization of the inflatable cuff which, in turn, leads to greater acceleration of venous flow and thus more effective therapy to the affected limb. The valve preferably is a two way valve so that when closed to the reservoir, it is open to atmosphere, allowing depressurization of the cuff.

Various constructions of inflatable cuffs are known in the art. For instance, the aforementioned '955 patent discloses a cuff configured to apply pressure to only the medial and lateral aspects of the limb, leaving open the anterior and posterior aspects, such that collateral, rather than circumferential, compression is achieved. To this end, the cuff comprises a pair of semi-rigid shells intended to be disposed along the medial and lateral aspects of the limb, with one or both of the shells being provided with inflatable bladders along the inner surfaces thereof The shells are secured around the injured limb such that when the valve opens the bladders are pressurized and the semi-rigid shells resist such pressure so that all the pressure is directed to the interior of the limb.

It is also known that intermittent pneumatic pressure applied to the underside or sole of the foot is efficacious in the treatment of DVT in lower extremities of a patient. Thus, foot cuffs have been developed, such as the cuff disclosed in U.S. Pat. No. Re. 32,940 issued to Gardner et al. In the device disclosed in that patent, an inflatable air bladder is held against the arch of the foot by a sling. When inflated, the bladder tends to flatten the plantar arch causing a spread of the heel with respect to the ball of the foot and, therefore, necking down of involved blood vessels. Other patents relating to foot cuff devices include U.S. Pat. No. 4,614,180 issued to Gardner et al., U.S. Pat. No. Re. 32,939 issued to Gardner et al., U.S. Pat. No. 4,696,289 issued to Gardner et al., U.S. Pat. No. 4,702,232 issued to Gardner et al., U.S. Pat. No. 4,721,101 issued to Gardner et al., and U.S. Pat. No. 4,841,956 issued to Gardner et al. Prior art foot cuff devices include a device offered under the name PlexiPulse®, by NuTech®, a KCI company; a device offered by Huntleigh Healthcare of Manalapen, N.J.; and a device offered by Kendall under the name AV Impulse System.

One disadvantage associated with prior art devices that apply pressure only to the plantar arch is that such devices provide neither prevention nor treatment of edema of the forefoot. In fact, such prior art devices may even lead to increased edema of the forefoot by forcing some internal fluid from the center region of the foot distally to the forefoot.

Another problem associated with such known inflatable foot cuffs is that with considerable pressure being exerted against the foot in a localized area, counterforces are correspondingly generated at circumferentially spaced regions of the foot. These counterforces can be quite substantial, and can cause skin irritation and in some cases skin breakdown as a result of the cuff chafing the foot after repeated cycles of inflation and deflation. The resulting discomfort can significantly reduce patient compliance. In known cuff devices, such chafing is common on the top of the foot and in the heel region. One known foot cuff that attempts to address this problem is the inflatable foot cuff marketed by Huntleigh Healthcare company of Manalapen, N.J. In that device, open cell foam padding vented to the atmosphere is added to the straps and heel of the cuff in the areas of typical irritation. However, a disadvantage of such a construction is that the vented foam tends to compress and bottom out under pressure, rendering it of little benefit. Because compliance is an important aspect of efficacious foot cuff use, it is desirable, therefore, to provide a foot cuff construction that can be used over extended periods of time while minimizing chafing of the foot as occurs with present cuff constructions. It is further desirable to provide such a foot cuff construction that has an improved air pressure sequence due to the use of multiple separate air cells for increased compression effect on the affected foot and greater enhancement of blood flow in the affected limb.

SUMMARY OF THE INVENTION

The present invention improves over the prior art by providing an inflatable foot cuff for treatment of deep vein thrombosis including a generally flexible body member configured to envelop a foot of a human and having a central region adjacent to the sole of the foot when applied thereon. A larger inflatable air cell is disposed in the central region of the flexible body member, such that when the device is applied to the foot the larger air cell extends over at least the entire plantar arch of the foot and at least a portion of the forefoot distal of the plantar arch. A smaller separately inflatable air cell preferably is disposed within the larger air cell and distally in the vicinity of the forefoot. Intermittent sequential inflation of the smaller distal air cell followed by inflation of the larger air cell causes blood flow from the distal region of the foot to the proximal region of the foot and then up into the user's leg, to enhance blood circulation in the leg. The compression of the forefoot provided by the device of the instant invention is also believed to be useful in the prophylaxis and treatment of forefoot edema. The body member is also provided with preinflated sealed air cells at counterforce pressure points to alleviate chafing and irritation of the skin when the foot cuff is operated.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENT

Figure 1:
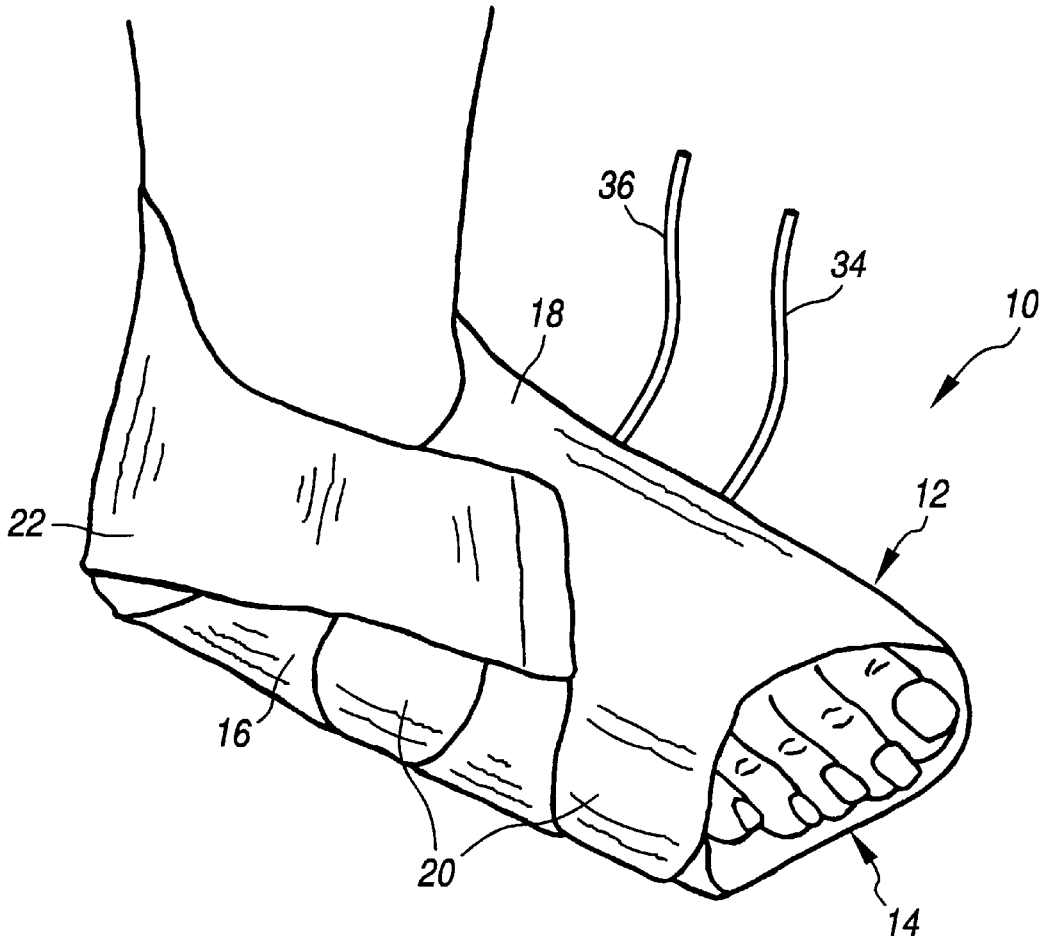
FIG. 1 is a perspective view of an inflatable foot cuff constructed in accordance with the principles of the invention and shown as fitted to the right foot of a patient.

Referring now to the drawings, and initially to FIG. 1, an inflatable foot cuff constructed according to the invention is designated generally by the reference numeral 10 and is shown as being fitted about a human foot. The cuff 10 compresses a unitary main body member 12 that includes a central lower portion 14 configured to abut the sole of the foot with a pair of flap portions 16 and 18 that are folded over the instep of the foot. Strap portions 20 are provided to fasten the flap portions snugly about the foot. A heel strap portion 22 is also provided to wrap around the heel of the foot and fasten to the flap portion 18.

Figure 2:
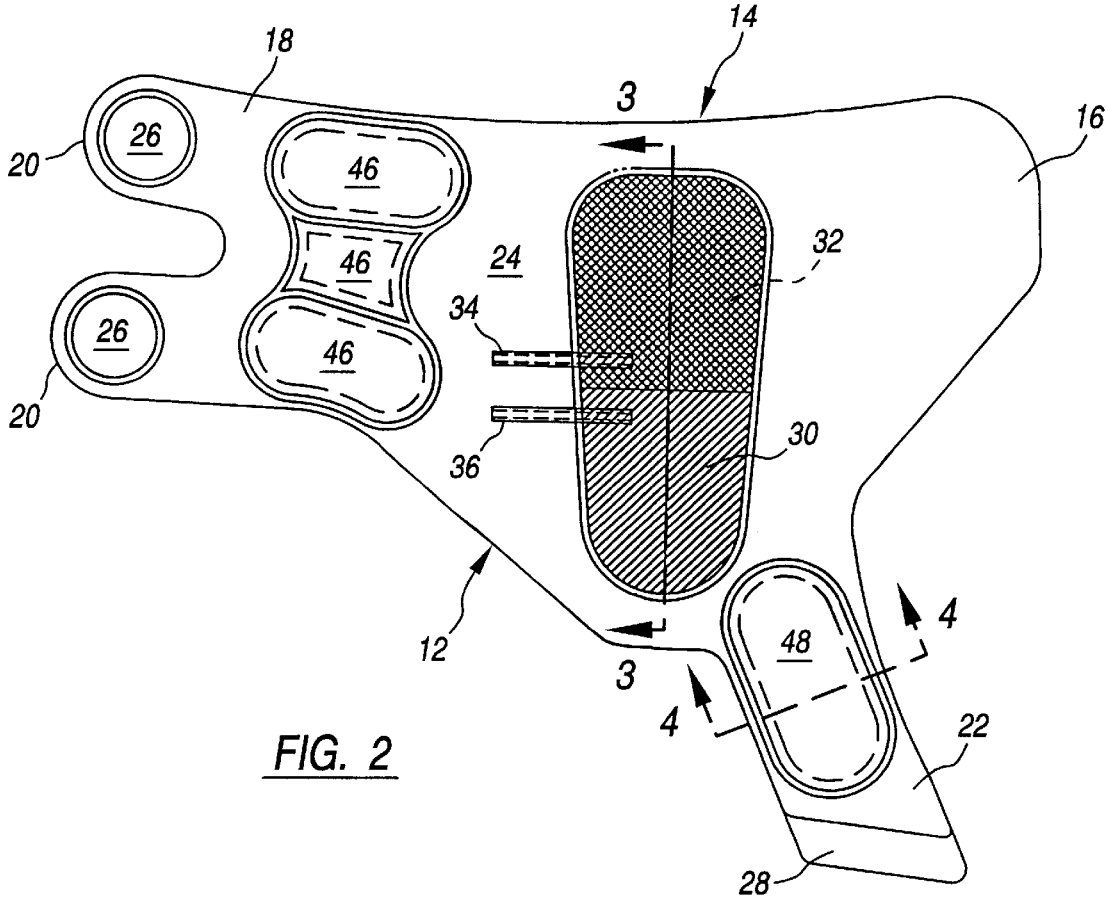
FIG. 2 is a top plan view of the foot cuff shown as unwrapped and lying flat.

Turning now to FIG. 2, the internal construction of the cuff 10 can be seen. Preferably the main body member 12 of the cuff 10 is a thin, flexible, substantially inelastic fabric material 24. In a preferred embodiment, fabric 24 will also have good breathability and good wicking capabilities for greater patient comfort. One example of a fabric suitable for use in the instant invention is a rayon-based fibrous material sold under the name SONTARA by E.I. duPont de Nemours Co., and including a laminate having loop fastening means on the side opposite that shown in FIG. 2. Hook type fastening elements 26 are preferably attached as by known means such as heat sealing to the strap portions 20. Similarly, a hook type fastening element 28 is attached as by similar known means to the end of the heel strap portion 22. In accordance with the invention, the central portion 14 of the cuff body 12 is provided with a relatively large main air cell 30 that extends over at least the entire plantar arch of the foot and at least a portion of the forefoot distal of the plantar arch. Within the main air cell 30 is a separate smaller inner air cell 32, about one-half the size of the main air cell 30, and which is disposed in the distal portion of the cuff 10 in the region of the forefoot and distal of the plantar arch. The air cells 30 and 32, as will be described hereinafter, are separately inflatable. To this end, a distal air supply tube 34 is connected to the smaller air,cell 32 while a proximal air supply tube 36 is connected to the larger air cell 30, both as by heat sealing.

Figure 3:
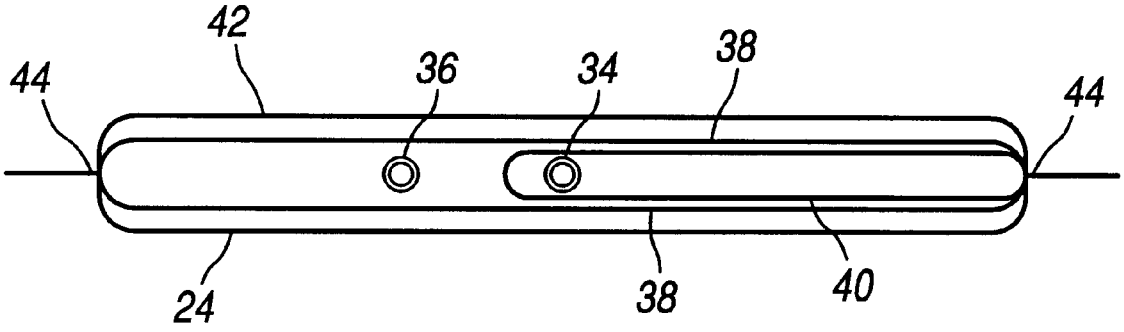
FIG. 3 is a schematic cross-sectional view taken substantially along the line 3—3 of FIG. 2.

FIG. 3 illustrates a cross-section of the air cell construction. Preferably, the outer air cell 30 is formed from two plies 38 of polymer film on the order of 0.006 inches in thickness. Similarly, the inner air cell 32 is formed from a folded piece of 0.006 inch thick polymer film 40. While many known polymers such as vinyl are suitable for this purpose, polyurethane is preferred for its strength, low temperature flexibility and resilience. An upper layer 42 of fabric material without loop laminate is provided substantially coextensive with the top ply 38 of outer air cell 30 and the air cell assembly is preferably thermally welded around its periphery 44 to the main body member 12 of the cuff 10. The inner air cell 32 is also heat sealed around three sides of its periphery to the periphery of the outer cell 30. Thus both cells 30 and 32 are sealed and attached to the fabric upper layer 42 and fabric loop laminate body layer 24.

Figure 4:
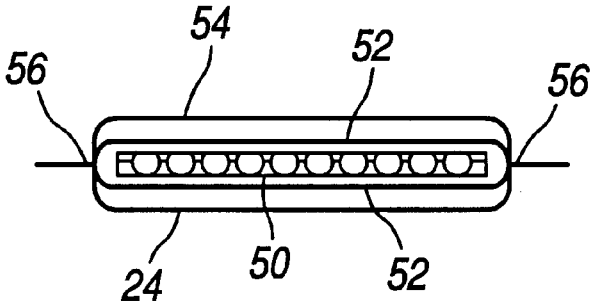
FIG. 4 is a schematic cross-sectional view taken substantially along the line 4—4 of FIG. 2.

Further, in accordance with the invention the flap portion 18 is provided with a generally H-shaped series of three preinflated sealed air cells 46 (see FIG. 2) for cushioning the counterforce of the flaps when the air cells 30 and 32 are inflated. Likewise, the heel strap portion 22 is provided with a preinflated sealed air cell 48. The construction of these air cells 46 and 48 is illustrated generally in the cross-sectional view of FIG. 4. The cells 46 and 48 generally comprise a layer 50 of open cell urethane foam on the order of 0.3 inch thick enveloped between two layers of urethane film 52 having a thickness of about 0.006 inch. The cells 46 and 48 are covered with a layer 54 of fabric material and are heat sealed around their peripheral edges 56 to the body layer 24. The foam layer 50 serves to preinflate the cells 46 and 48.

It can now be appreciated that a therapeutic inflatable foot cuff 10 constructed according to the invention offers considerable advantages over the prior art. An important feature of the present cuff 10 is the provision of the dual inflatable air cells 30 and 32. The air cells 30 and 32 essentially provide overlapping separate zones. Using a modified version of the pump assembly disclosed, for example, in the aforementioned U.S. Pat. No. 5,588,955, a first zone may be inflated, which can be the smaller distal air cell 32, then at a predetermined time interval thereafter, a second overlapping zone can be inflated such as by pressurizing the larger air cell 30. The advantage of such sequential compression is that the cuff 10 can be pretightened on the distal portion of the foot by the inflation of air cell 32 so that inflation of the second air cell 30 has an instantaneous compression effect over both the distal and plantar arch portions of the foot. Secondly, this sequential compression helps ensure that blood moves from the distal region of the foot to the proximal region and then up the leg. This discourages retrograde flow, which could contribute to swelling of the forefoot or toes in some patients with poor circulation. Also, the novel configuration of the heel strap portion 22 allows the user of the cuff 10 to adjust the strap portion 22 only once, such that the cuff 10 can be removed and reapplied without further strap 22 adjustment.

In one embodiment, the device of the instant invention will operate intermittently on a time cycle such that the pump cycles on for a relatively short period and off for a much longer period. Based on information derived from studies on the ejection of blood from the calf and thigh by prior art devices, an operation cycle of about six seconds on and 55 seconds off can be used. The foot has a much smaller volume than the calf and thigh, and therefore will refill with blood much more quickly. This phenomenon allows more on-off cycles in a shorter period of time. Thus, for a foot cuff device made and used in accordance with the instant invention, it is believed that a cycle time of about three seconds on and about 20 seconds off will also be effective.

When the pump is turned on, the smaller distal cell will inflate first. The larger cell will begin to inflate about 0.3 seconds after the distal cell begins to inflate. The inflation pressure in each cell will vary depending on how tightly the cuff is strapped on to the patient's foot. The peak inflation pressure may vary from 100–160 mmHg, and generally will be in an average range of 110–140 mmHg. When the pump enters the non-operational phase of its cycle, the pressure in the two cells will drop off rapidly as the compressed air is vented through the relief valves to the atmosphere. The pressure can drop to about 52 mmHg in the smaller distal cell, and about 45 mmHg in the larger cell. The inflation rate of each cell preferably will be greater than about 60 mmHg/sec, and can be as high as 200 mmHg/sec. Variations in the foregoing cycle times, peak inflation pressures, and inflation rate can be achieved by adjustments of the associated pump and valves. A programmable pump can also be used to pre-select the inflation parameters.

Another important feature is the preinflated sealed air cells 46 and 48 provide a considerable cushioning effect for the cuff 10 in the regions of both the instep and heel of the foot as the cuff 10 is inflated with the air cells 30 and 32. This cushioning aids considerably in reducing chafing and irritation of the foot due to counterpressure of the cuff 10 when it is in operation over extended and repeated cycles. It is believed that the greater comfort provided by the instant invention will lead to improved patient compliance.

While the invention has been described in connection with a preferred embodiment thereof, it will be apparent to those skilled in the art that many changes and modifications may be made without departing from the true spirit and scope of the present invention. Accordingly, it is intended by the appended claims to cover all such changes and modifications as come within the sprit and scope of the invention.

What is claimed is:

1. An inflatable foot cuff device for providing enhanced circulation to the foot and leg of a human patient, the device comprising:

a body member dimensioned and configured to envelop a foot of a human, said body member having a central region extending along the sole of the foot when applied thereon;

inflatable means comprising a main inflatable air cell and a separately inflatable distal air cell, said inflatable means disposed in said central region of said body member such that when said body member is applied to the foot, said main inflatable air cell extends along at least the entire plantar arch of the foot and at least a portion of the forefoot distal of the plantar arch, and said separately inflatable distal air cell extends along a portion of the forefoot distal of the plantar arch, said separately inflatable distal air cell being coextensive with and inside at least a portion of said main inflatable air cell distal of the plantar arch; and means for establishing an intermittent cycle of sequential inflation of said distal air cell followed by inflation of said main air cell to provide intermittent pneumatic pressure to the foot.

2. The foot cuff device of claim 1 wherein said distal air cell is about one-half the size of said main air cell.

3. The foot cuff device of claim 1 wherein a pair of opposed flap portions extend outwardly from said central region of said body member.

4. The foot cuff device of claim 3 wherein one of said flap portions is provided with fastening means to attach to the other flap portion.

5. The foot cuff device of claim 4 wherein said fastening means comprises a hook element.

6. The foot cuff device of claim 1 wherein said body member includes a heel strap portion extending outwardly and rearwardly from said central region.

7. The foot cuff device of claim 6 wherein said heel strap portion is dimensioned and configured to wrap around the heel of the user and attach to said body member.

8. The foot cuff device of claim 7 wherein said heel strap is provided with a hook fastening element for attachment to said body member.

9. The inflatable foot cuff device of claim 1 further comprising a pump means and fluid connections means extending between said pump means and each of said main and distal air cells to facilitate sequential inflation of said distal and main air cells.

10. The inflatable foot cuff device of claim 9 further comprising pressure relief means associated with each of said main and distal air cells.

11. The inflatable foot cuff device of claim 9 wherein said pump means is programmable.

12. An inflatable foot cuff device for use in providing enhanced circulation to the foot and leg of a human patient, the device comprising:

a body member dimensioned and configured to envelop a foot of a human, said body member having a central region adjacent to the sole of the foot when applied thereon;

a main inflatable air cell disposed in said central region of said body member such that when said body member is applied to the foot said main air cell extends over at least the entire plantar arch of the foot and at least a portion of the forefoot distal of the plantar arch;

a separately inflatable distal air cell disposed so as to provide compression to the forefoot distal of the plantar arch;

wherein an intermittent cycle of sequential inflation of said distal air cell followed by inflation of said main air cell provides intermittent pneumatic pressure to the foot and results in enhanced blood circulation in the foot and leg of the patient;

said foot cuff device further comprising a pair of opposed flap portions extending outwardly from said central region of said body member; and one of said flap portions being provided with at least one preinflated air cell to serve as a cushioning means.

13. An inflatable foot cuff device for use in providing enhanced circulation to the foot and leg of a human patient, the device comprising:

a body member dimensioned and configured to envelop a foot of a human, said body member having a central region adjacent to the sole of the foot when applied thereon;

a main inflatable air cell disposed in said central region of said body member such that when said body member is applied to the foot said main air cell extends over at least the entire plantar arch of the foot and at least a portion of the forefoot distal of the plantar arch;

a separately inflatable distal air cell disposed so as to provide compression to the forefoot distal of the plantar arch;

wherein an intermittent cycle of sequential inflation of said distal air cell followed by inflation of said main air cell provides intermittent pneumatic pressure to the foot and results in enhanced blood circulation in the foot and leg of the patient;

said body member including a heel strap portion extending outwardly and rearwardly from said central region;

said heel strap portion being provided with a preinflated air cell to serve as cushioning means.

14. A method for providing enhanced circulation to the foot and leg of a human patient comprising the steps of:

providing a flexible body member dimensioned and configured to envelop a foot of the patient and having a central region that extends along the sole of the foot;

providing inflatable means comprising a main inflatable air cell and a separately inflatable distal air cell, said inflatable means disposed in said central region of said body member, such that when said body member is applied to the foot, said main air cell extends along at least the entire plantar arch of the foot and at least a portion of the forefoot distal of the plantar arch, and with said distal air cell disposed so as to be coextensive with and inside at least a portion of said main air cell distal of the plantar arch and to provide a separate compression zone to the forefoot distal of the plantar arch;

applying said body member to said foot with said inflatable means extending along the sole of the foot; and intermittently and sequentially pressurizing said distal air cell and then said main air cell at a predetermined time interval to provide intermittent pneumatic pressure to the foot.

15. The method of claim 14 wherein said body member is provided with a pair of opposed flap portions extending from said central region for wrapping around and enveloping the foot.

16. The method of claim 15 wherein said central region is provided with an outwardly projecting heel strap portion.

17. The method of claim 14 wherein a peak inflation pressure of each of said main and distal air cells is in the range of about 100–160 mmHg.

18. The method of claim 17 wherein a peak inflation pressure of said main and distal air cells is in the range of about 110–140 mmHg.

19. The method of claim 14 wherein said sequential pressurization is applied intermittently, such that peak pressurization is applied over a relatively short period, and the pressure is relieved over a relatively long period.

20. The method of claim 19 wherein said relatively short period is about six seconds and said relatively long period is about 55 seconds.

21. The method of claim 19 wherein said relatively short period is about three seconds and said relatively long period is about 20 seconds.

22. A method for providing enhanced circulation to the foot and leg of a human patient comprising the steps of:

providing a flexible body member dimensioned and configured to envelop a foot of the patient and having a central region that extends along the sole of the foot;

providing main and distal separately inflatable air cells in said central region of said body member, such that when said body member is applied to the foot, said main air cell extends along at least the entire plantar arch of the foot and at least a portion of the forefoot distal of the plantar arch and with said distal air cell disposed so as to provide a separate compression zone to the forefoot distal of the plantar arch;

applying said body member to said foot with the sole of the foot abutting said central region and air cells;

intermittently and sequentially pressurizing said distal air cell and then said main air cell at a predetermined time interval to provide intermittent pneumatic pressure to the foot;

said body member being provided with a pair of opposed flap portions extending from said central region for wrapping around and enveloping the foot;

at least one of said flap portions being provided with at least one preinflated air cell to serve as cushioning means.

23. A method for providing enhanced circulation to the foot and leg of a human patient comprising the steps of:

providing a flexible body member dimensioned and configured to envelop a foot of the patient and having a central region that extends along the sole of the foot;

providing main and distal separately inflatable air cells in said central region of said body member, such that when said body member is applied to the foot, said main air cell extends along at least the entire plantar arch of the foot and at least a portion of the forefoot distal of the plantar arch and with said distal air cell disposed so as to provide a separate compression zone to the forefoot distal of the plantar arch;

applying said body member to said foot with the sole of the foot abutting said central region and air cells;

intermittently and sequentially pressurizing said distal air cell and then said main air cell at a predetermined time interval to provide intermittent pneumatic pressure to the foot;

said body member being provided with a pair of opposed flap portions extending from said central region for wrapping around and enveloping the foot;

said central region being provided with an outwardly projecting heel strap portion;

said heel strap portion being provided with a preinflated air cell to serve as cushioning means.

24. A method for providing enhanced circulation to the foot and leg of a human patient comprising the steps of:

providing a flexible body member dimensioned and configured to envelop a foot of the patient and having a central region that extends along the sole of the foot;

providing main and distal separately inflatable air cells in said central region of said body member, such that when said body member is applied to the foot, said main air cell extends along at least the entire plantar arch of the foot and at least a portion of the forefoot distal of the plantar arch and with said distal air cell disposed so as to provide a separate compression zone to the forefoot distal of the plantar arch;

applying said body member to said foot with the sole of the foot abutting said central region and air cells;

intermittently and sequentially pressurizing said distal air cell and then said main air cell at a predetermined time interval to provide intermittent pneumatic pressure to the foot;

wherein the inflation rate of each of said main and distal air cells is in the range of about 60–200 mmHg/sec.

25. A method for providing enhanced circulation to the foot and leg of a human patient comprising the steps of:

providing a flexible body member dimensioned and configured to envelop a foot of the patient and having a central region that extends along the sole of the foot;

providing main and distal separately inflatable air cells in said central region of said body member, such that when said body member is applied to the foot, said main air cell extends along at least the entire plantar arch of the foot and at least a portion of the forefoot distal of the plantar arch and with said distal air cell disposed so as to provide a separate compression zone to the forefoot distal of the plantar arch;

applying said body member to said foot with the sole of the foot abutting said central region and air cells;

intermittently and sequentially pressurizing said distal air cell and then said main air cell at a predetermined time interval to provide intermittent pneumatic pressure to the foot;

wherein said main air cell begins to inflate about 0.3 seconds after said distal air cell begins to inflate.

* * * * *